US006553705B2

(12) United States Patent
Geiberger et al.

(10) Patent No.: US 6,553,705 B2
(45) Date of Patent: Apr. 29, 2003

(54) CHANGEABLE FRAME

(76) Inventors: Christoph Geiberger, Arrenberger Strasse 65, 42117 Wuppertal (DE); Michael Schwarz, Castroper Strasse 34, 44628 Herne (DE)

( * ) Notice: Subject to any disclaimer, the term of this patent is extended or adjusted under 35 U.S.C. 154(b) by 74 days.

(21) Appl. No.: 09/808,678

(22) Filed: Mar. 14, 2001

(65) Prior Publication Data

US 2001/0023549 A1 Sep. 27, 2001

(30) Foreign Application Priority Data

Mar. 21, 2000 (DE) ..... 200 05 195 U

(51) Int. Cl.[7] ..... A47G 1/06
(52) U.S. Cl. ..... 40/793; 40/647
(58) Field of Search ..... 40/793, 792, 790, 40/658, 647

(56) References Cited

U.S. PATENT DOCUMENTS

| | | | | | |
|---|---|---|---|---|---|
| 4,145,828 | A | * | 3/1979 | Hillstrom | 40/647 |
| 4,261,123 | A | * | 4/1981 | Mariotti | 40/791 |
| 4,756,107 | A | * | 7/1988 | Hillstrom | 160/378 |
| 4,958,458 | A | * | 9/1990 | Hillstrom et al. | 40/647 |
| 5,279,056 | A | * | 1/1994 | Komamura | 40/758 |
| 5,608,980 | A | * | 3/1997 | Pangerl | 292/251.5 |
| 5,930,928 | A | * | 8/1999 | Kantola et al. | 40/611 |
| 2001/0023549 | A1 | | 9/2001 | Geiberger et al. | |

FOREIGN PATENT DOCUMENTS

| | | |
|---|---|---|
| DE | 29809261 U1 | 10/1998 |
| DE | 298 07 565 | 9/1999 |
| DE | 200 05 194 | 7/2000 |
| EP | 1 136 020 | 9/2001 |

* cited by examiner

*Primary Examiner*—William L. Miller
(74) *Attorney, Agent, or Firm*—R W Becker & Associates; R W Becker

(57) ABSTRACT

A changeable frame for supporting flat surfaced items such as pictures, posters, placards or the like, is provided, which includes a plurality of frame border strips which collectively form the border of the changeable frame. Each frame border strip includes a base profile member and a cover member movable between a closed item retaining position in which an item is retained by the changeable frame and the cover member partially extends over and exerts a resilient biasing force against the item and an open position. Each frame border strip also includes a pivot arrangement for pivotally mounting the base profile member and the cover member to one another. The pivot arrangement includes a fulcrum formed on the base profile member which is contacted by a counter stop surface formed on the cover member to prevent an overpivot movement of the cover member beyond its predetermined pivot travel.

7 Claims, 1 Drawing Sheet

CHANGEABLE FRAME

BACKGROUND OF THE INVENTION

The present invention relates to a changeable frame for supporting flat surfaced items such as pictures, posters, placards or the like with frame border strips which form the borders of the changeable frame, whereby the frame border strips each includes a base profile member, a pivot element pivotally mounted via a pivot mounting to the base profile member, and a cover member that extends over the pivot element as a cover and, in a closed position in which an item is retained by the frame border strips in the changeable frame, partially extends over the item and resiliently biases an item retaining element against the item.

Changeable frames of the type noted above are conventionally known and are a preferred application for advertising and marketing purposes. Such changeable frames offer the advantage over other conventional changeable frame configurations that they permit an exchange of the item retained in the changeable frame via a simple hand grip action. In this connection, as can be readily imagined, the pivot elements and the cover member covering these pivot elements are snapped outwardly out of the plane of the frame such that the item retained on the frame is released and can subsequently be removed out of the front of the frame. A new item such as, for example, an advertising placard, a new brochure, or the like can now be installed in the changeable frame in the same manner and can be clamped in the changeable frame via return movements of the pivot elements and the cover member to their closed item retaining positions.

A frame of the type noted is described, for example, in DE 298 09 261. The changeable frame described in that prior art reference comprises three functional components—namely, a base profile member, a pivot element, and a frame border strip and is characterized by the fact that the frame border strip functions as a resiliently biasing member. According to this prior art reference, the noted functional components can be elaborated as separate components and, for the assembly of the frame border strip therewith, the components can be interconnectable with one another by, for example, friction fit elements. Alternatively, the components can be elaborated in an already assembled condition. This can be accomplished, for example, by coextrusion, whereby film hinge connections can be provided, for example, in the connection areas of the functional components.

The changeable frames of the type just described, particularly in their elaboration in a manner in which the frame border strips are comprised of separate finished components releasably interconnectable with one another to form a frame, suffer from the disadvantage that, in connection with a frame opening pivot movement of the pivot element and the respective frame border strip which covers the pivot element, it cannot be precluded that there occurs an overpivot movement or, in other words, a pivot movement of the components beyond the predetermined frame opening pivot travel paths of these components. In the event of an overpivot movement, it can occur that the individual components, which are releasably interconnected to one another to form the frame border strip, separate from one another such that the border of the frame must be constantly re-assembled by repeat interconnection of the individual components to one another.

SUMMARY OF THE INVENTION

The present invention offers a solution to the challenge of providing a changeable frame of the type hereinbefore noted which reliably prevents an overpivot movement of the pivoting components of the changeable frame beyond their predetermined frame opening positions. To furnish this solution, the pivot hinge assembly pivotally interconnecting the base profile member and the pivot element of the changeable frame of the present invention preferably includes a stop element, which prevents an overpivot movement.

A stop element of the type comprised in the changeable frame of the present invention presents an especially simple and very effective solution for preventing an overpivot movement beyond the maximum predetermined pivot movement, which terminates at a predetermined frame opening position. This solution also ensures, in the event that the frame border strip is comprised of releasably interconnectable pieces, that the pivot and cover elements cannot come loose from the base profile member due to an overpivot movement.

In accordance with one feature of the changeable frame of the present invention, the pivot arrangement between the base profile member and the pivot element advantageously comprises a fulcrum and a follower portion, whereby the fulcrum includes an arcuate convex outer surface portion and the follower portion includes an arcuate concave surface portion dimensioned in correspondence with, and operable to move in following movement along, the arcuate convex outer surface portion of the fulcrum.

The just described configuration of the pivot arrangement represents a simple pivot connection that ensures the reliably guided pivot movement that is required in the pivoting of the pivot element. The follower portion engages and follows with its arcuate concave surface portion the arcuate convex outer surface portion of the fulcrum and a gliding relative movement between the arcuate concave surface portion and the arcuate convex outer surface portion occurs. This pivot arrangement serves at the same time as the pivot axis for a pivot movement of the pivot element between the two pivot movement end positions—namely, the one end position corresponding to the closed item retaining position of the frame border strip and the other end position corresponding to the open item releasing position of the frame border strip. In connection with such a pivot arrangement, an offset in the arcuate convex outer surface portion of the fulcrum can advantageously serve as a stop surface for contacting a counter stop surface formed by a transverse end portion which extends radially inwardly from the arcuate concave surface portion of the pivot element. The arcuate convex outer surface portion of the fulcrum has a reduced radius relative to the next following arcuate outer surface portion of the fulcrum such that the transition between the two arcuate outer surface portions forms the offset and the arcuate concave surface portion of the pivot element is guided along the reduced radius arcuate convex outer surface portion of the fulcrum during the pivot movement until the counter stop surface on the transverse end portion contacts the offset, whereupon further pivoting of the pivot element is prevented.

One can achieve a still higher assurance that an overpivot movement of the pivot element will be prevented if another portion of the fulcrum opposite to the offset is configured as a projecting outer surface portion operable as a second stop surface for contacting a second counter stop surface formed at another end of the follower portion of the pivot element, whereby the locations of the second stop surface and the second counter stop surface are selected such they contact one another at the maximum predetermined pivot travel extent of the pivot element at the same time as the stop surface and the counter stop surface contact one another. The pivot element thus contacts the two respective stop surfaces with its two ends so that an overpivot movement of the pivot element can be reliably prevented even in the event of large pivot opening movement forces.

The fulcrum can be formed on the base profile member and the follower portion can be formed on the pivot element although an opposite arrangement can also be configured—that is, the follower portion can be formed on the base profile member and the fulcrum can be formed on the pivot element.

It is further recommended, in connection with the changeable frame of the present invention, that the cover member itself is connected to the base profile member at a pivot location, whereby a stop surface is provided on the base profile member which is contacted by a counter stop surface formed on the cover member contemporaneously with the contact of the counter stop surface of the pivot element with the associated stop surface of the base profile member. In this manner, a pivot movement of the pivot element effects a pivot movement of the cover member, which is connected to the pivot element, about the associated pivot location on the base profile member and the contact of the counter stop surface of the cover member with the associated stop surface on the base profile member offers further protection against an overpivot movement of the pivoting components of the changeable frame, as this stop action contact between the cover member and the base profile member has an additional movement limiting effect, if the pivot element contacts at least one of the associated stop surfaces on the base profile member.

One can benefit from an advantage in terms of production and flexibility in the assembly of the frame border strips if, as is provided by a further feature of the changeable frame of the present invention, the cover member, the base profile member, and the pivot element are embodied as separately produced pieces and are releasably connectable with one another. This permits the production of separate cover members, base profile members, and pivot elements, which can be combined as desired with one another. Thus, it can be imagined that a single unit type base profile member can be provided with various pivot elements and cover members. This is advantageous, for example, if frames of differing outside dimensions are to be produced. The width of the cover member is accommodated based on optical aesthetic considerations to the frame dimensions. In the eye of a frame beholder, a small cover member used with a large frame—that is, a frame with an extended height and width—appears to be too small; the frame beholder has the impression that the proportions are not suited for each other. Also, a cover member that is too small may not securely retain an item in the frame. For this reason, it is necessary to provide larger frames with wider cover members. Conversely, a cover member which is too wide with respect to a relatively smaller frame appears to the eye of a frame beholder as over-dimensioned. Through the assembly of the frame border strip from separate pieces, the pivot element and the cover member connected thereto can be selected in consideration of the width of the base profile member which corresponds to the frame dimensions and used for the assembly of the frame border strip. Additionally, cover members of various configuration as regards the characteristics of the transparent properties thereof can be selected and combined as desired which contributes to a visible expansion of the range of configurations which can be used.

Moreover, in accordance with another feature of the changeable frame of the present invention, the cover member is configured as a piece which is at least partially transparent. This opens up the possibility that the portion below the transparent portion of the cover member can be seen through the cover member. It can thus be provided, for example, that decorative elements can be provided which are arranged underneath the cover members in the closed position of the changeable frame and are visible through the transparent portions of the cover members. As an enhancement, means can be provided on the cover member for receiving the decorative elements. Also, the pivot elements can include such means. In this manner, one can benefit from a higher degree of flexibility in view of the variations of the optical appearances which an embodiment of the changeable frame of the present invention may have. Differently configured decorative elements such as, for example, printed decorative elements can be arranged as desired in the arrangements disclosed hereinabove and can be changed in a simple manner. Accordingly, for example, the impression of a wood frame can be brought forth by use of a decorative element having an imitation wood surface. It can also be imagined that variously colored, geometrically patterned decorative elements or similarly configured decorative elements can be used. At the same time, advertising imprints, for example, can be made visible through the transparent cover members.

In accordance with a further advantageous feature of the changeable frame of the present invention, a lengthwise slot is provided on a side of the base profile member turned away from the cover member. This slot can be provided with one or several undercuts. A slot of this type can serve several purposes. For example, a fastening means for fastening of the changeable frame of the present invention to, for example, a wall or the like can be seated in the slot and thereby ensure the fastening of the changeable frame to the wall or the like. It can be imagined that functional elements can be fixedly seated in a slot of such a configuration which are configured to serve various purposes. For example, a correspondingly configured functional element can connect two changeable frames in a back-to-back manner. It is also imaginable that a functional element can be slotted into the slot formed in the base profile member which is configured with a hanger means or a fastening device for hanging or fastening the changeable frame to a mounting location. A functional element provided in the form of a hanger means can serve to mount the changeable frame, which is connected with the hanger means via the slot, to a wall, a support or stand, a room covering, or the like, with the assistance of known mounting means.

BRIEF DESCRIPTION OF THE DRAWINGS

The object and advantages of the present invention will be explained in more detail with the aid of the accompanying drawings, in which.

DETAILED DESCRIPTION OF THE PREFERRED EMBODIMENT

Figure 1A:
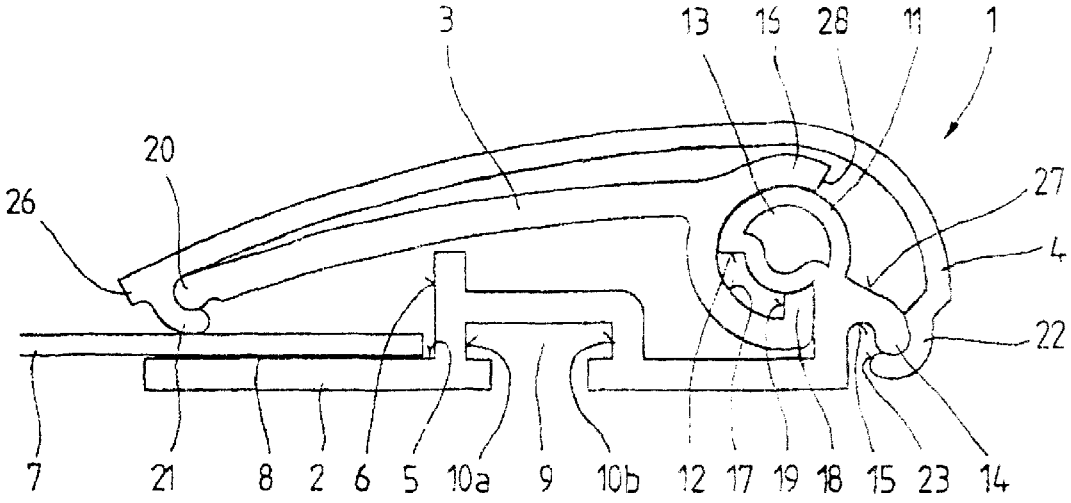
FIG. 1*a* is a sectional view of one embodiment of the changeable frame of the present invention showing the changeable frame in its closed item retaining position.
Figure 1B:
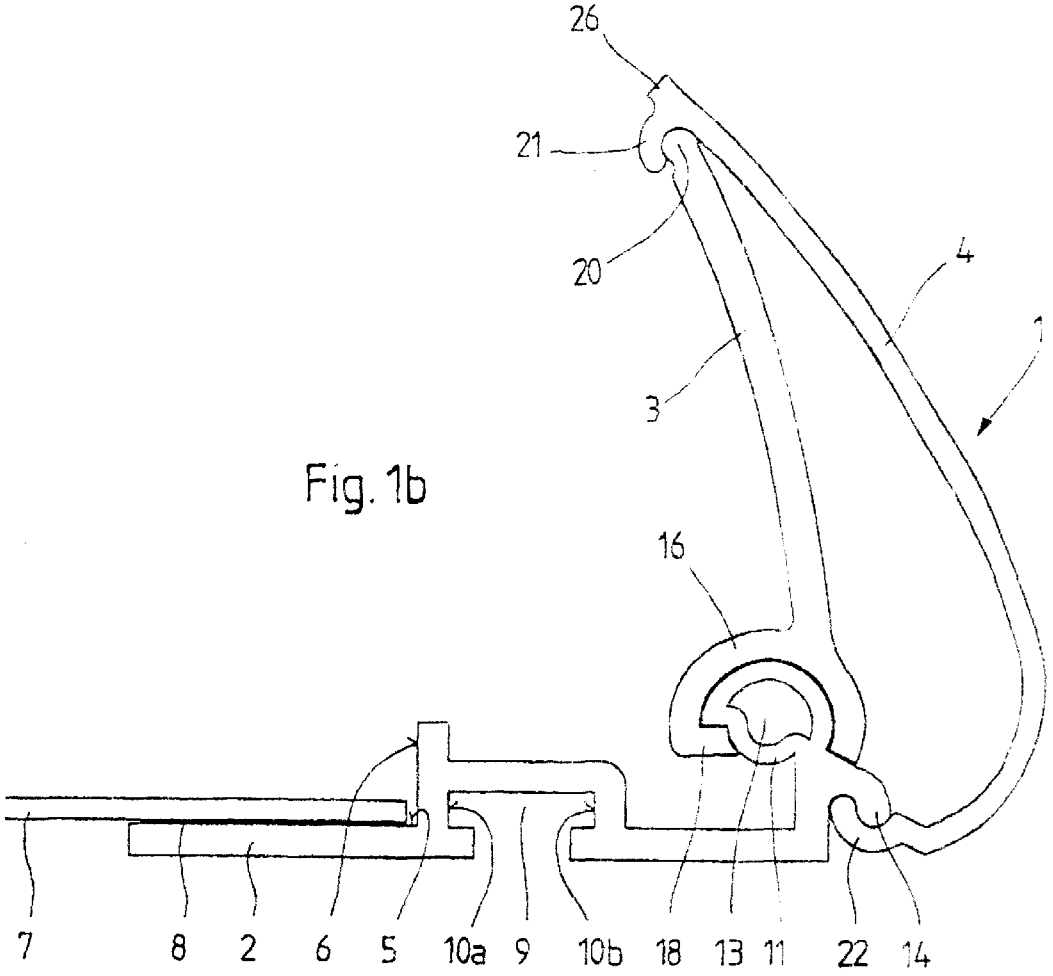
FIG. 1*b* is a sectional view of the one embodiment of the changeable frame of the present invention which is shown in FIG. 1*a* and showing the changeable frame in its open item releasing position.

In FIGS. 1*a* and 1*b*, the parts in one figure of the drawings are designated by the same reference numerals as the identical parts in the other figure of the drawings. FIG. 1*a* shows a sectional view of one embodiment of the changeable frame of the present invention in its closed item retaining position. The changeable frame of the present invention is bordered on all sides by a frame border strip 1. The sectional view of the changeable frame in FIG. 1*a* shows the frame border strip 1 as well as a portion of the picture backing element 7 which is in engagement with the frame border strip 1. The frame border strip 1 is substantially comprised of three components. These components are a base profile member 2, a pivot element 3 movably connected to the base profile member 2, and a cover member 4 extending in covering relationship over the base profile member 2 and the pivot element 3.

The base profile member 2 comprises, on the extent thereof extending along the interior border of the changeable frame, a layout surface 5 whose outer edge in the direction of the exterior border of the changeable frame is defined by a shoulder wall 6 extending substantially perpendicularly to the layout surface. The layout surface 5 operates to support the picture backing element 7. The picture backing element 7 lies on the layout surface 5 and is adhered thereagainst by an adhesive strip 8. The adhesive strip 8 comprises two opposed, self adhering oversurfaces. One of the self adhering oversurfaces of the adhesive strip 8 is adhered to the layout surface 5 and the other self adhering oversurface is adhered to that portion of the underside of the picture backing element 7 which overlies the layout surface 5. The base profile member 2 includes a slot 9 extending lengthwise there along. Two undercuts 10*a*, 10*b* are each formed in a respective side of the slot 9 in opposition to the other undercut. Two fulcrums 11, 14 are formed on the base profile member on its exterior edge. The fulcrum 11 is comprised of two segments each of which has an arcuate outer surface. The arcuate outer surfaces of the two segments of the fulcrum 11 have differing radii and two respective adjacent ends of the two arcuate outer surfaces are connected to one another by a stop surface 12 extending substantially radially to the arcuate outer surfaces. The fulcrum 11 encloses a hollow passage 13. The fulcrum 14 is formed on the frame exterior edge of a stop surface 27 which extends generally radially outwardly from the fulcrum 11. A stop surface 15 is formed along the connection of the fulcrum 11 to the underside of the stop surface 27. The pivot element 3 is pivotably mounted at one end thereof on the fulcrum 11.

The pivot element 3 includes a follower portion 16 on its one end adapted for mounting the pivot element to the fulcrum 11 along the arcuate surface 17. One end of the follower portion 16 has a radially inwardly angled leg 18 which follows the lesser radius arcuate outer surface of the pair of segments of the fulcrum 11, which is formed on the base profile member 2. The turned in leg 18 thus forms a counter stop surface 19 extending along the surface of the leg 18 facing the stop surface 12. The opposite end of the follower portion 16 has a counter stop surface 28 formed thereon for engaging the stop surface 27 formed on the base profile member 2. The pivot element 3 further includes, at an end thereof opposite to the end on which the follower portion 16 is formed, a fulcrum 20. A socket 21 formed on the end of the cover member 4 pivotally receives therein the fulcrum 20 to thereby pivotally interconnect the end of the cover member 4 with the pivot element 3.

A follower portion 22 is formed on another end of the cover member 4 for following the fulcrum 14 formed on the base profile member 2. Thus, it can be seen that the three core components of the frame border strip—namely, the base profile member 2, the pivot element 3, and the cover member 4—are movably interconnected with one another via the various fulcrums and the follower portions. The cover member 4 comprises as well a counter stop surface 23 formed at the termination of the follower portion 22, the counter stop surface 23 cooperating with the stop surface 15 formed on the base profile member 2. A grip engagement portion 26 is formed on the cover member 4 adjacent the socket 21.

FIG. 1*b* shows the same sectional view of the frame border strip 1 as the frame border strip is shown in its closed item retaining position in FIG. 1*a* except that, in FIG. 1*b*, the frame border strip is shown in its open item releasing position—that is, the pivot element 3 and the cover member 4 are pivoted outwardly. It can be seen that, in this position, the counter stop surface 19 formed on the pivot element 3 is in contact with the stop surface 12 formed on the fulcrum 11, the counter stop surface 28 formed on the pivot element 3 is in contact with the stop surface 27 formed on the base profile member 2, and the counter stop surface 23 formed on the cover member 4 is in contact with the stop surface 15 formed on the base profile member. Further outward pivoting of the pivot element 3 and the cover member 4 in the frame border strip opening direction is thus foreclosed by the stop actions of the three stop surface-counter stop surface contacts. In this manner, an overpivot movement of the referenced pieces and a consequential loosening or release of the connections between the individual pieces is thereby foreclosed.

It can be seen in FIG. 1*a* that the counter stop surface 21 formed on the cover member 4 presses against, and lies upon, the picture backing element 7 due to the locations of the pivot element 3 and the cover member 4 in the closed position of the frame border strip. In this manner, an item disposed upon the picture backing element 7 and which is to be retained in the frame such as, for example, a poster, a placard, or the like, is, together with a transparent cover which may be disposed over the item, held in its frame retained position by the pressing action of the counter stop surface 21. This pressing action is reinforced by a resiliently biasing force which is exerted by the cover member 4. The effective distance between the fulcrum 20 and the fulcrum 14 initially increases, due to the movement of the pivot element 3 and the cover member 4 during the frame opening movement from the closed position shown in FIG. 1*a* into the opening position shown in FIG. 1*b*, until the completion of the opening movement of the frame border strip into its open position shown in FIG. 1*b*, whereupon the distance between the fulcrums 14, 20 generally corresponds to the distance between the fulcrums in the closed position of the frame border strip shown in FIG. 1*a*. In this manner, the cover member 4, which extends from the fulcrum 14 to the fulcrum 20 and is engaged by the two fulcrums, is initially overextended or bent out of its normal shape during the initial portion of the opening movement of the frame border strip and thereafter returns to its normal shape as the frame border strip completes its opening movement into its open position. The cover member 4 is, therefore, comprised of a flexible material such as, for example, a plastic material, so that it translates its deformation due to the overextension into a potential resiliently biasing force. The deformation of the cover member 4 produces counter forces which are exerted as a resiliently biasing force acting to retain the moving pieces in the closed position of the frame border strip shown in FIG. 1*a* or, alternatively, acting to retain the moving pieces in the open position of the frame border strip shown in FIG. 1*b*.

The slot 9 shown in FIGS. 1*a* and 1*b*, together with the two undercuts 10*a* and 10*b*, can be used for various purposes. The configuration of the slot 9 with the two undercuts 10*a* and 10*b* permits the introduction of correspondingly dimensioned elements into the slot and the seating of projections into the undercuts. Such elements can be used, for example, to connect two frames together in back-to-back manner or to accommodate mounting elements for mounting the frame on a wall. Additionally, connecting elements can be introduced into the slot for configuring a corner connection as can be required for the assembly together of individual components of the frame border strip 1 into a fully assembled frame. In this connection, the individual frame border strips can be, for example, miter cut and thereafter fixedly mounted together through the insertion of right angled connection pieces into the slot 9 of the frame border strips 1 which border one another.

In the one embodiment of the changeable frame of the present invention described herein, the base profile member 2, the pivot element 3, and the cover member 4 are configured as separate parts and are connected to one another by friction fit or snap fit to form the frame border strip 1. This offers the advantage that the individual parts can be produced through comparatively cost favorable processes such as, for example, by extrusion, laid out together in correspondence with the desired length of the frame border strip 1, and then inserted together by simple connection configurations to form the frame border strip 1. This approach avoids the assembly of individual fulcrum connections as is necessitated, for example, in the use of film hinge connections and which can only be realized through resource demanding coextrusion processes. Moreover, various base profile members 2, pivot elements 3, and cover members 4 can be combined as desired to assemble a frame border strip of the present invention.

The cover member 4 can be opaque, colored, or transparent. A transparent cover member offers the possibility of permitting the item which is overlaid by the cover member to be visible. Thus, for example, a decorative composition can be provided underneath a transparent cover member 4, whereby the decorative composition is easy to exchange for another composition so as to thereby facilitate a simple and quick re-configuration of the changeable frame.

One skilled in the art can imagine a multitude of further embodiments of the changeable frame of the present invention in addition to the one embodiment of the changeable frame of the present invention described herein which, as well, make use of the core concept of the present invention. Individual characteristics of the changeable frame described and/or illustrated herein can be combined in various ways with one another. The one embodiment of the changeable frame of the present invention has been described herein merely for the purpose of explaining the changeable frame of the present invention and is not to be understood as a limitation on the scope of the invention.

The afore described one embodiment of the changeable frame of the present invention thus clearly shows that a changeable frame has been provided in accordance with the present invention which effectively prevents an overpivot movement of the pivoting components of the changeable frame beyond a predetermined outward opening position.

The specification incorporates by reference the disclosure of German priority document 200 05 195.4 of Mar. 21, 2000.

The present invention is, of course, in no way restricted to the specific disclosure of the specification and drawings, but also encompasses any modifications within the scope of the appended claims.

What we claim is:

1. A changeable frame for supporting a flat surfaced item, comprising: a plurality of frame border strips which collectively form the borders of the changeable frame, each frame border strip including:

a base profile member having a fulcrum;

a cover member movable between a closed item retaining position, in which the item is retained by the changeable frame and the cover member partially extends over and exerts a force against the item to assist in retaining the item in the changeable frame, and an open position in which the cover member does not exert a force against the item;

a pivot element pivotally mounted to the fulcrum of the base profile member, the pivot element extending between the base profile member and the cover member and engaging the cover member, the pivot element being pivotable about the fulcrum of the base profile member upon the application of a frame opening force on the frame border strip and, in connection with such pivoting of the pivot element, the pivot element guiding the movement of the cover member from its closed item retaining position into its open position;

a first stop surface formed on the base profile member;

a first counter stop surface formed on the pivot element for engaging the first stop surface formed on the base profile member such that, in connection with the completion of pivoting movement of the pivot element about the fulcrum during which the pivot element guides the cover member from its closed item retaining position into its open position, the first counter stop surface on the pivot element engages the first stop surface formed on the base profile member to thereby prevent further pivoting movement of the pivot element about the fulcrum;

a second stop surface formed on the base profile member; and a second counter stop surface formed on the pivot element, the second stop surface formed on the base profile member and the second counter stop surface formed on the pivot element engaging one another to resist disengagement of the pivot element from its pivot mounting position on the fulcrum of the base profile member in the event that a frame opening force continues to be applied to the frame border strip after the first stop surface on the base profile member and the first counter stop surface on the pivot element have already engaged one another to stop further pivoting of the pivot element about the fulcrum of the base profile member.

2. A changeable frame according to claim 1 wherein the fulcrum includes an arcuate convex outer surface and the pivot element includes a follower portion having an arcuate concave surface corresponding to the arcuate convex outer surface of the fulcrum for following movement therealong during the pivot movement.

3. A changeable frame according to claim 2 wherein the arcuate convex outer surface of the fulcrum terminates at an end on which the second stop surface is formed and the arcuate concave surface terminates at an end on which the second counter stop surface is formed transversely to the second stop surface.

4. A changeable frame according to claim 1 wherein the base profile member includes a slot extending along a side of the base profile member turned away from the cover member.

5. A changeable frame according to claim 1 wherein the cover member is pivotally mounted to the base profile member at a pivot location at a spacing from the fulcrum and includes a cover counter stop surface and the base profile member includes a cover stop surface, the cover stop surface and the cover counter stop surface contacting one another generally contemporaneously with the contact of the first stop surface formed on the base profile member and the first counter stop surface formed on the pivot element.

6. A changeable frame according to claim 5 wherein the base profile member, the cover member, and the, pivot element are separately manufactured pieces and are releasably connectable with one another.

7. A changeable frame according to claim 5 wherein the cover member is at least partially transparent.

* * * * *